US008368528B2

(12) United States Patent
Savage, Jr. et al.

(10) Patent No.: US 8,368,528 B2
(45) Date of Patent: Feb. 5, 2013

(54) CONFIGURABLE NOTIFICATION DEVICE

(75) Inventors: Kenneth E. Savage, Jr., Fitchburg, MA (US); Michael A. Furtado, Shrewsbury, MA (US)

(73) Assignee: SimplexGrinnell LP, Westminster, MA (US)

( * ) Notice: Subject to any disclaimer, the term of this patent is extended or adjusted under 35 U.S.C. 154(b) by 616 days.

(21) Appl. No.: 12/572,014

(22) Filed: Oct. 1, 2009

(65) Prior Publication Data

US 2011/0080280 A1 Apr. 7, 2011

(51) Int. Cl.
*G08B 1/08* (2006.01)

(52) U.S. Cl. ..... 340/533; 340/506; 340/525

(58) Field of Classification Search ..... 340/533, 340/517, 506, 514, 538, 531, 508, 521–525
See application file for complete search history.

(56) References Cited

U.S. PATENT DOCUMENTS

| | | | | |
|---|---|---|---|---|
| 5,659,287 | A * | 8/1997 | Donati et al. | 340/331 |
| 5,705,979 | A * | 1/1998 | Fierro et al. | 340/517 |
| 6,426,697 | B1 * | 7/2002 | Capowski et al. | 340/506 |
| 7,508,303 | B2 | 3/2009 | Capowski et al. | |
| 8,063,763 | B2 * | 11/2011 | Barrieau et al. | 340/514 |
| 2005/0057367 | A1 | 3/2005 | Regh | |
| 2008/0157962 | A1 | 7/2008 | Penney et al. | |

* cited by examiner

*Primary Examiner* — Daniel Previl
(74) *Attorney, Agent, or Firm* — Brinks, Hofer, Gilson & Lione

(57) ABSTRACT

A notification device includes a processing module configured to determine a communication mode capability of an alarm panel. The processing module communicates with the control using the determined communication mode. The notification device also includes an output module that is in electrical communication with the processing module. The output module is configured to produce an output signal in response to a signal communicated by the alarm panel.

26 Claims, 5 Drawing Sheets

CONFIGURABLE NOTIFICATION DEVICE

BACKGROUND

I. Field

The present invention relates generally to emergency alerting systems installed in buildings. More specifically, the present invention relates to a configurable notification device.

II. Background Details

During construction of new buildings, various devices such as smoke detectors and fire alarm notification devices are mounted and wired throughout the structure. This work usually occurs before the drywall and painting has been completed. The various devices may be wired to an alarm panel that monitors the status of the devices. Some systems utilize an addressable communication protocol to monitor the status of the notification devices. In these systems, each notification device is assigned a unique address and the alarm panel may monitor the status of the device by communicating a status request message to the notification device and by receiving a response to the status request from the notification device.

Other systems utilize a non-addressable communication protocol. In these systems, a first polarity DC voltage is communicated during a supervisory mode of operation from the alarm panel to the notification devices. In this mode, a rectifier in each of the respective notification devices prevents activation of the notification device. A passive component such as a resistor is placed at the end of a given circuit to provide a path for current to flow. The alarm panel monitors this current flow to determine whether there is a break in the continuity of the wiring that connects the notification devices to the alarm panel. In an active mode, the polarity of the DC voltage is reversed, which in turn forward biases the rectifiers in the respective notification devices thus enabling activation of the notification devices.

One problem with addressable and non-addressable notification devices is that they are not interchangeable. That is, a non-addressable notification device cannot be utilized in a system that utilizes an addressable communication protocol and vice versa. This burdens the field installer with having to carry both types of notification devices when on a repair call.

SUMMARY

In one aspect, a notification device includes a processing module configured to determine whether an alarm panel communicates using an addressable or a non-addressable communication protocol. The processing module communicates with the alarm panel using the determined communication mode.

The notification device also includes an output module that is in electrical communication with the processing module. The output module is configured to produce an output signal in response to a signal communicated by the alarm panel. The output module may correspond to a strobe, a horn, a speaker, or other output device.

Communications between the processing module and the alarm panel may occur over a pair of conductors. The processing module determines the communication mode capability of the alarm panel by detecting data levels and/or data patterns on the pair of conductors. The processing module may also derive power from the pair of conductors via power control circuitry that is configured to generate power from signals detected on the pair of conductors.

In some embodiments, the processing module is disposed in a base housing and the output module is disposed in an output module housing. The output module housing is configured to be removably attached to the base housing.

DETAILED DESCRIPTION

To overcome the problems described above, a configurable notification device is provided. The notification device communicates with an alarm panel via network wiring and is configured to determine a communication protocol supported by the alarm panel by analyzing signals present on the network wiring. Once the notification device determines the correct communication protocol, the notification device communicates with the alarm panel using the detected communication protocol. Various communication protocols such as addressable and non-addressable communication protocols may be detected and the notification device may be configured to communicate using any of the detected protocols.

Figure 1:
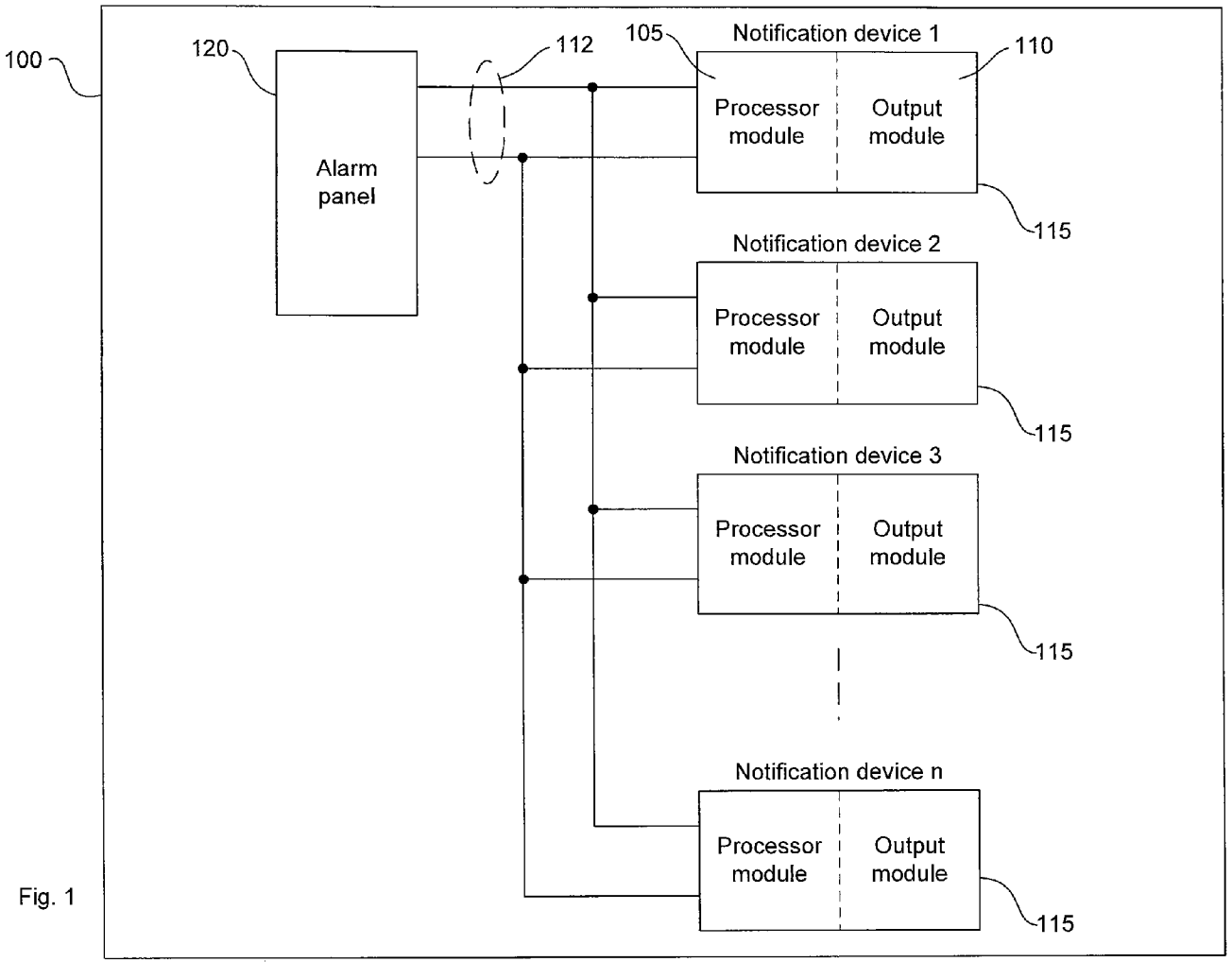
FIG. 1 is a schematic representation of an emergency alert system that may be utilized in a building or other structure.

FIG. 1 is a schematic representation of an emergency alert system 100 that may be utilized in a building or other structure. The emergency alert system 100 includes an alarm panel 120 and a group of notification devices 115. The alarm panel 120 may include circuits, processors, memories and/or other components operable to communicate power to the notification devices 115, detect the status of the notification devices 115, and signal the notification devices 115 to activate.

In some implementations, the alarm panel 120 is configured to communicate with the notification devices 115 via a non-addressable communication protocol. An alarm panel 120 configured for non-addressable communications may include a DC power supply to power the notification devices 115. The polarity of the DC power supply may be configured to be reversible to enable testing of the continuity of the network wires 112 that connect the alarm panel 120 to the notification devices 115.

In other implementations, the alarm panel 120 is configured to communicate with the notification devices 115 via an addressable communication protocol. An alarm panel 120 configured for addressable communications may include a power supply and circuitry operable to modulate the power supply with a data stream. For example, the alarm panel 120 may include parallel-to-serial converter circuits, shift registers, line drivers, and/or other circuits that enable modulating the power supply. The data stream may correspond to any serial data stream. For example, the data stream may include start, stop, and/or parity bits. Information communicated in the data stream may be formatted into packets of data bits. The packets may define addresses for targeting data to a specific notification device 115 or for requesting status information from a targeted notification device 115. The packets may also define configuration information for configuring the notification device 115 with the corresponding address.

The alarm panel 120 may also be configured to produce audio signals for broadcast over loud speakers. For example, the alarm panel 120 may be interfaced to an audio source (not shown) such as a microphone or an audio playback device. Audio from the audio source may be amplified and communicated by the alarm panel 120 to speakers or to notification devices with audio output capabilities. The audio signals may be communicated, for example, during an emergency or when testing the emergency alert system.

Each notification device 115 includes circuits, processors, memories, and/or other components that enable the notification device to generate a notification event, such as the activation of a strobe, the sounding of a horn, and/or the annunciation of a warning via a speaker.

Each notification device 115 may include a processing module 105 and an output module 110. As described in more detail below, the processing module 105 may be configured to determine communication mode capabilities of the alarm panel 120 such as whether the alarm panel 120 is an addressable controller or a non-addressable controller. After determining the alarm panel capabilities, the processing module 105 may communicate with the alarm panel 120 using the determined communication mode. For example, if the processing module 105 detects an addressable mode of communication, the processing module 105 may dynamically configure itself to communicate via an addressable communication mode. In this mode, the processing module 105 may, for example, communicate data that defines that status of the notification device 115 in response to a status request from the alarm panel 120.

The processing module 105 may also implement configuration and status requests communicated from the alarm panel 120. For example, data that defines the intensity of a strobe may be communicated from the alarm panel 120 to the processing module 105. The processing module 105 may store this information in a memory and the value stored may be utilized to control the strobe intensity when the strobe is activated. Alternatively, the configuration information and/or the status request may be communicated to the output module 110. For example, a status request packet for requesting the status of an output module 110 may be communicated from the alarm panel 120 to the processing module 105. The processing module 105 may then query the output module 110 to determine the requested status and may then communicate the status back to the alarm panel. For example, an alarm panel 120 may communicate a request to determine the type of output module 110 connected to the processing module 105 and also request a model number of the output module 110. The processing module 105 may query the output module to determine the information and communicate the information back to the alarm panel 120.

If the processing module 105 detects a non-addressable communication mode, the processing module 105 may be dynamically configured to communicate using that mode instead. In this mode, the processing module 105 may be configured to stay idle or in standby when the polarity of the voltage on the network wiring 112 indicates a supervisory mode of operation and to activate when the polarity of the voltage on the network wiring 112 corresponds to an active mode.

Each notification device 115 may include an output module 110 that is in electrical communication with the processing module 105. The output module 110 is configured to produce an output signal in response to a signal communicated by the alarm panel 120. For example, the output module 110 may be configured to activate a strobe in response to an activation voltage communicated by a non-addressable controller 120. Alternatively or in addition, the output module 110 may be configured to activate the strobe in response to a data request communicated from the alarm panel 120. The output module 110 may be configured to produce output signals for other notification devices such as horns, speakers, and/or other devices.

In some implementations, the processing module 105 and the output module 110 are housed in a unified housing assembly (not shown). In other implementations, the processing module 105 and the output module 110 are housed in different housings. For example, the processing module 105 may be housed in a base housing (not shown), and the output module 110 may be housed in an output module housing (not shown) that is configured to be removably attached to the base housing. The output module housing and the base housing may include complementary connectors configured to provide a path for data communications and/or power between the base housing and the output module housing. The base housing may be installed during an initial building stage of a structure. For example, the base housing may be installed before the drywall in a building is installed. This enables testing of the network wiring 112 between the alarm panel 120 and at least the processing module 105 of the notification device 115 during a time when it is relatively easy to fix wiring problems. The output module housing may be installed at a later time.

Figure 2:
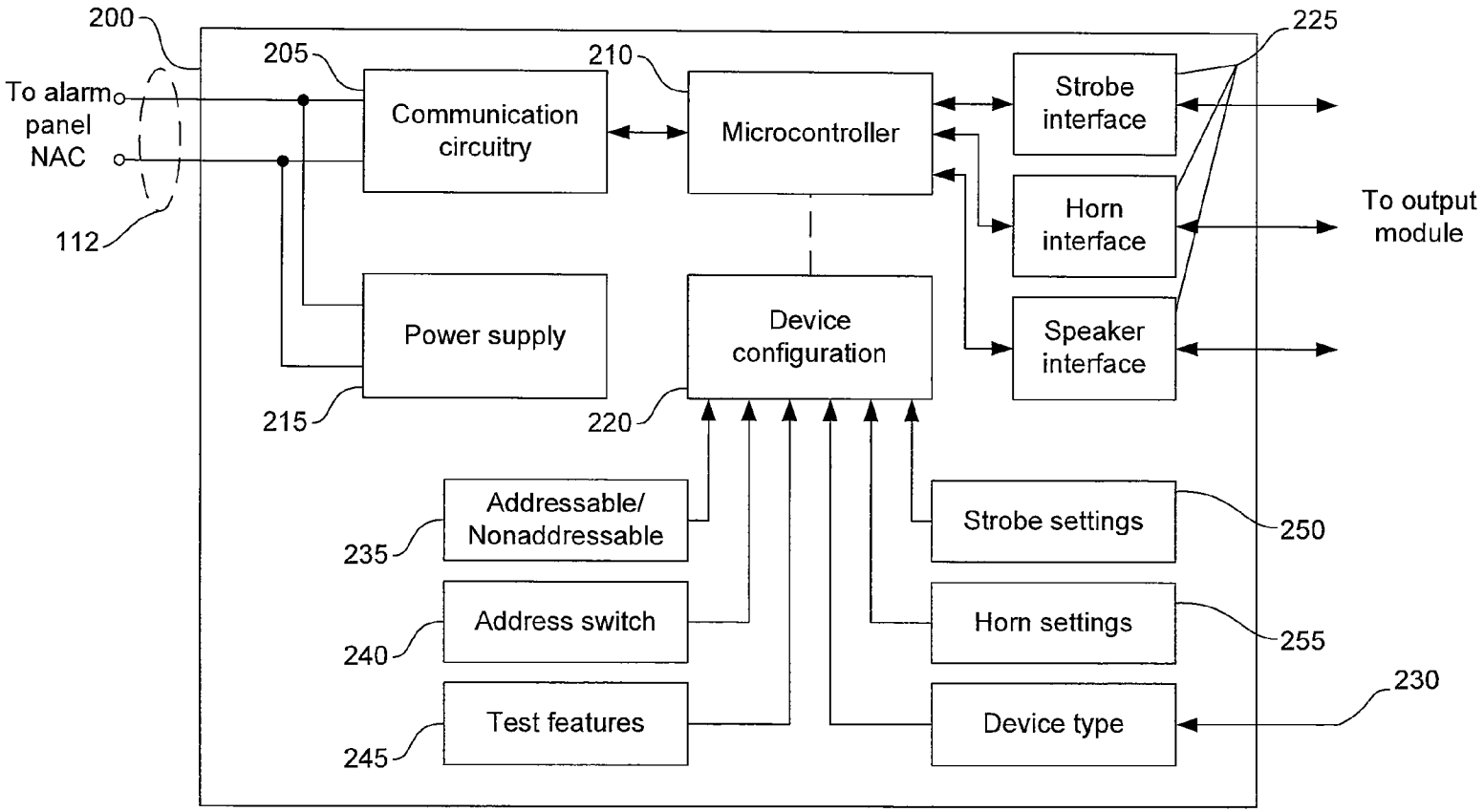
FIG. 2 is a block diagram of an exemplary processing module.

FIG. 2 is a block diagram of an exemplary processing module 200 that may correspond to the processing module 105 identified above. The processing module 200 includes communication circuitry 205, a power supply 215, a microcontroller 210, a device configuration block 220, and various output interfaces 225.

The communication circuitry 205 may include logic, circuitry and/or code that enable communications between the processing module 200 and an alarm panel 120 (FIG. 1). The communication circuitry 205 may be configured to detect voltage levels present on the network wiring 112 to determine whether any data is being communicated on the network wiring 112. For example, the communication circuitry 205 may include one or more voltage threshold detectors operable to determine whether the voltage on the network wiring 112 fluctuates between voltages corresponding to data bits.

The communication circuitry 205 may also be configured to determine whether any detected data bits correspond to valid data. For example, the communication circuitry 205 may include parallel-to-serial convertors, shift registers and other logic and circuitry that enable the detection of start bits, stop bits, and parity bits. These bits may enable the detection of packets of information in a data stream communicated on the network wiring 112. The packets may include address information that identifies a device for which information in the packet is intended and also device specification information, such as configuration information for configuring characteristics of the notification device. In some implementations, the communication circuitry 205 extracts information stored in the packets and communicates the information to the microcontroller 210.

The communication circuitry 205 may include circuitry for communicating the communication mode capabilities of the alarm panel to the microcontroller 210. The microcontroller 210 may utilize this information to dynamically configure the processing module 200 for the appropriate communication mode. For example, if data signals are not detected, the communication circuitry 205 may set a bit in a status register indicating this fact. In the non-addressable communication mode, the communication circuitry 205 may communicate the polarity of the DC voltage detected on the wiring to the microcontroller 210.

The power supply 215 includes circuitry that enables the generation of power from voltage present on the network wiring 112. The power supply 215 may include rectifiers, regulators, switching power supply circuits and/or other circuits operable to convert voltage on the network wiring 112 into one or more voltages for powering the processing module 200 and the output module 110 (FIG. 1). These circuits may enable the power supply 215 to convert voltages modulated by data patterns into a DC power source. The power supply 215 may also be configured to generate power for the processing module 200 from a non-addressable system regardless of the polarity of the DC voltage on the wiring.

The microcontroller 210 may correspond to any general microcontroller that is operable to carry out a set of operations based on instructions stored in a memory. The microcontroller 210 may include one or more processors, timers, memory controllers, inputs, outputs, memories, and/or different components. The processor(s) may correspond to a reduced-instruction-set core (RISC), a complex-instruction-set core (CISC), and/or a different core and may be based on an Intel®, AMD®, ARM®, or different architecture.

The device configuration block 220 may include logic, code, and/or circuitry that enable the configuration of the processing module 200 and/or an output module. In some implementations, the device configuration block 220 may correspond to a memory or a location within a memory that is in electrical communication with the microcontroller 210. In other implementations, the device configuration block 220 may correspond to one or more input pins on the microcontroller 210 that are utilized to specify configuration information. In yet other implementations, the device configuration block may include one or more switches, such as dip switches, that enable configuring the processing module 200 and/or enable the processing module 200 to configure the output module. For example, switches for specifying the intensity of a flash or the frequency of the flash of the strobe module may be provided. Other switches for configuring other types of output modules may also be provided.

The configuration information enables configuring the address of the processing module 200. For example, address switches 240 for specifying an address may be provided. In other implementations, the address may be stored in a memory during the manufacture of the processing module 200 or at a different time. For example, the configuration information may be communicated to the processing module 200 via an interface or download port (not shown), such as a wired port, an RF port, an infra red port, and/or a different port.

In some implementations, the configuration information enables the configuration of the communication mode supported by the processing module 200. For example, a mode switch 235 may be utilized to force the processing module 200 to use a specific communication protocol.

Other configuration information may enable controlling the characteristics of various output devices. For example, the configuration information may enable configuring features such as text features 245 of a display that is in electrical communication with the microcontroller 210. The intensity of a strobe or the frequency of a strobe may be specified via strobe settings 250 stored or specified by the configuration information. Horn settings 255 or speaker settings such as an audio alert type and volume may be stored or specified by the configuration information. Other information may also be specified.

In some implementations, configuration information for configuring several possible output modules may be stored or specified by the device configuration block 220. The configuration information stored or specified by the device configuration block 220 may be retrieved based on the state of a device type input 230 that identifies the type of output module connected to the processing module 200. The type of output module device may be determined, for example, by detecting the value of a resistor on the output module that is coupled to the device type input 230.

In yet other implementations, the configuration information may specify the type of output module to be connected to the processing module 200. For example, a selector switch for specifying the type of output module may be provided. The information may be utilized to force the processing module 200 to work with a specific output module. In some implementations, the insertion of an incorrect output module may trigger a warning event. For example, the processing module may include an audio alert mechanism, a warning LED, or other indicator utilized to warn an operator when an incorrect output module is inserted. In addition or alternatively, the processing module 200 may communicate to an alarm panel that an incorrect device is inserted when the alarm panel requests status information from the processing module 200.

The output interfaces 225 are configured to match complementary interfaces on various output modules. The output circuitry interfaces 225 are configured to transfer power and communicate with the output modules. For example, a strobe interface circuit may transfer power to a strobe module and may also communicate signals utilized to configure or control the behavior of the strobe module, such as the intensity and/or flash frequency of a flash of the strobe module. A horn interface circuit may be utilized to transfer power and/or communicate configuration signals to a horn module, such as signals to control the audio signal produced by a horn of a horn module. A speaker interface circuit may be utilized to transfer power and/or communicate configuration signals to a speaker, such as signals to control the volume of a speaker output of a speaker module.

Figure 3A:
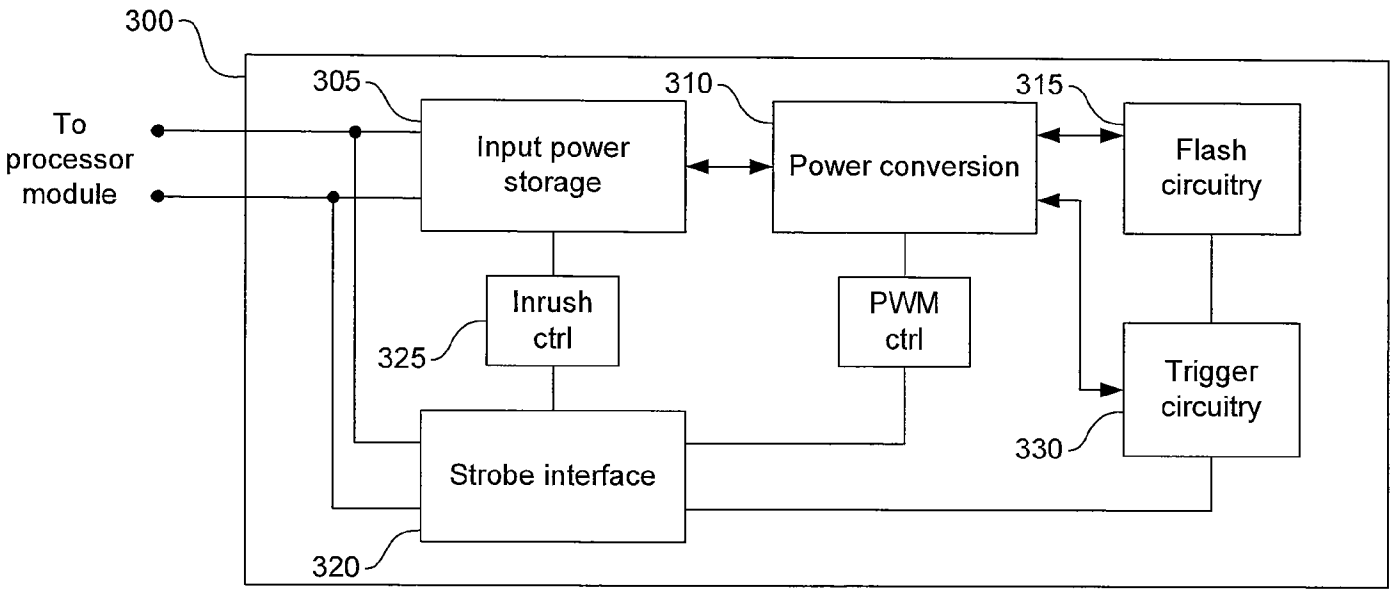
FIG. 3A is a block diagram of an exemplary strobe output module.

FIG. 3A is a block diagram of an exemplary strobe module 300 that may correspond to the output module 110 (FIG. 1), described above. The strobe module 300 includes a strobe interface 320, input power storage circuitry 305, a power converter 310, a flash circuit 315, and a trigger interface 330.

The input power storage circuitry 305, power converter 310, flash circuit 315, and trigger circuit 330 cooperate to produce a voltage signal with an intensity great enough to energize a flash. For example, the input power storage 305 may correspond to a capacitor or other storage device for storing energy. An inrush control circuit 325 may control the rate at which the input storage circuit 305 stores energy to prevent excessive current flow into the strobe module 300. The power converter 310 may correspond to a voltage amplification circuit such as a transformer based circuit. For example, a DC-to-AC circuit may convert DC energy transferred from the power converter 310 to AC voltage. The AC voltage may then be increased via, for example, a step-up transformer, to a voltage great enough to activate a flash such as a xenon flash or LED.

The strobe interface 320 may be in electrical communication with a complementary strobe output interface of the processing module 200 (FIG. 2). The strobe interface 320 may be utilized to control the behavior of the strobe module 300 and/or communicate configuration signals and/or information from the processing module to the various blocks shown in FIG. 3A. For example, the strobe interface 320 may be utilized to configure the behavior of the power converter 310 so as to control various characteristics of the strobe, such as the frequency and intensity of the flash. Other characteristics of the strobe module 300 may be configured via the strobe interface 320.

In some implementations, the strobe interface 320 may include a storage device such as a memory for storing configuration information that controls the characteristics of the strobe module 300. For example, strobe capability information, such as the maximum lumen capability of the flash or flash usage information, may be stored in the memory and communicated to the processing module. In other implementations, the strobe interface 320 relays configuration information communicated by the processing module to the various blocks shown in FIG. 3A.

Figure 3B:
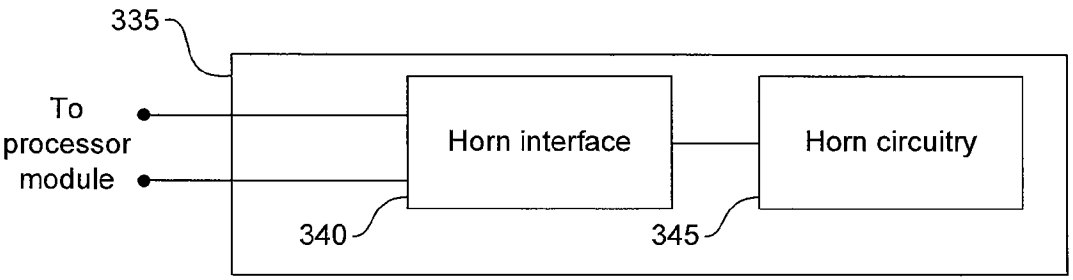
FIG. 3B is a block diagram of an exemplary horn output module.

FIG. 3B is a block diagram of an exemplary horn module 335 that may correspond to the output module 110 (FIG. 1), described above. The horn module 335 includes a horn interface 340 and horn circuitry 345. The horn interface 340 may be in electrical communication with a complementary horn output interface of a processing module. The horn interface 340 may be utilized to control the behavior of the horn circuitry 345 and/or communicate configuration signals and/or information from the processing module to the horn circuitry 345 to control characteristics such as the audio signal produced by a horn (not shown).

The horn circuitry 345 may include circuitry for generating a horn audio signal and may also include a horn (not shown). For example, the horn circuitry 345 may include various amplifiers, oscillators, drivers, and/or other circuits configured to generate a signal with an intensity great enough to drive a horn.

Figure 3C:
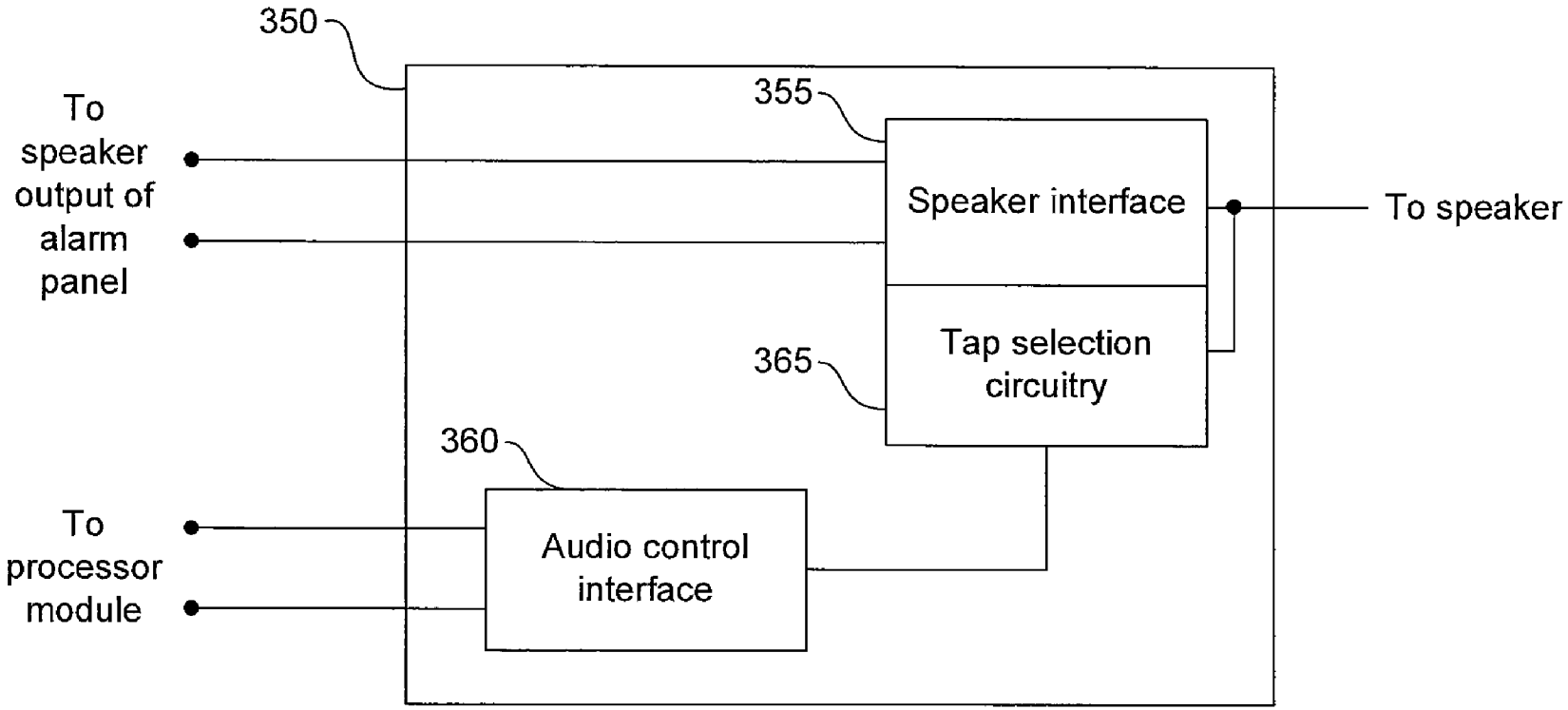
FIG. 3C is a block diagram of an exemplary speaker output module.

FIG. 3C is a block diagram of an exemplary speaker module 350 that may correspond to the output module 110 (FIG. 1), described above. The speaker module 350 includes a speaker interface 355 and an audio control interface 360. The speaker interface 355 may be configured to interface a speaker output of an alarm panel 120 (FIG. 1) to a speaker (not shown). The speaker interface 355 may include a transformer with one or more secondary taps that enable adjusting the volume of audio produced by the speaker. The taps may be selectively coupled to the speaker via tap selection circuitry 365. The tap selection circuitry 365 may correspond to one or more solid state or mechanical switches configured to open and close based upon the state of a control signal.

The audio control interface 360 is configured to interface with a complementary interface of the processing module. The audio control interface 360 enables the configuration of the speaker interface 355 by the processing module. For example, audio level configuration information may be communicated from the processing module to the speaker interface 355 via the audio control interface 360. An output of the audio control interface 360 may be coupled to the tap selection circuitry 365 of the speaker interface 355 to enable control of the selected tap by the processing module.

In some implementations, the blocks of a strobe module 300, horn module 335, and speaker module 350 may be combined to produce a unified notification device that supports strobe, horn, and/or speaker functions.

Figure 4:
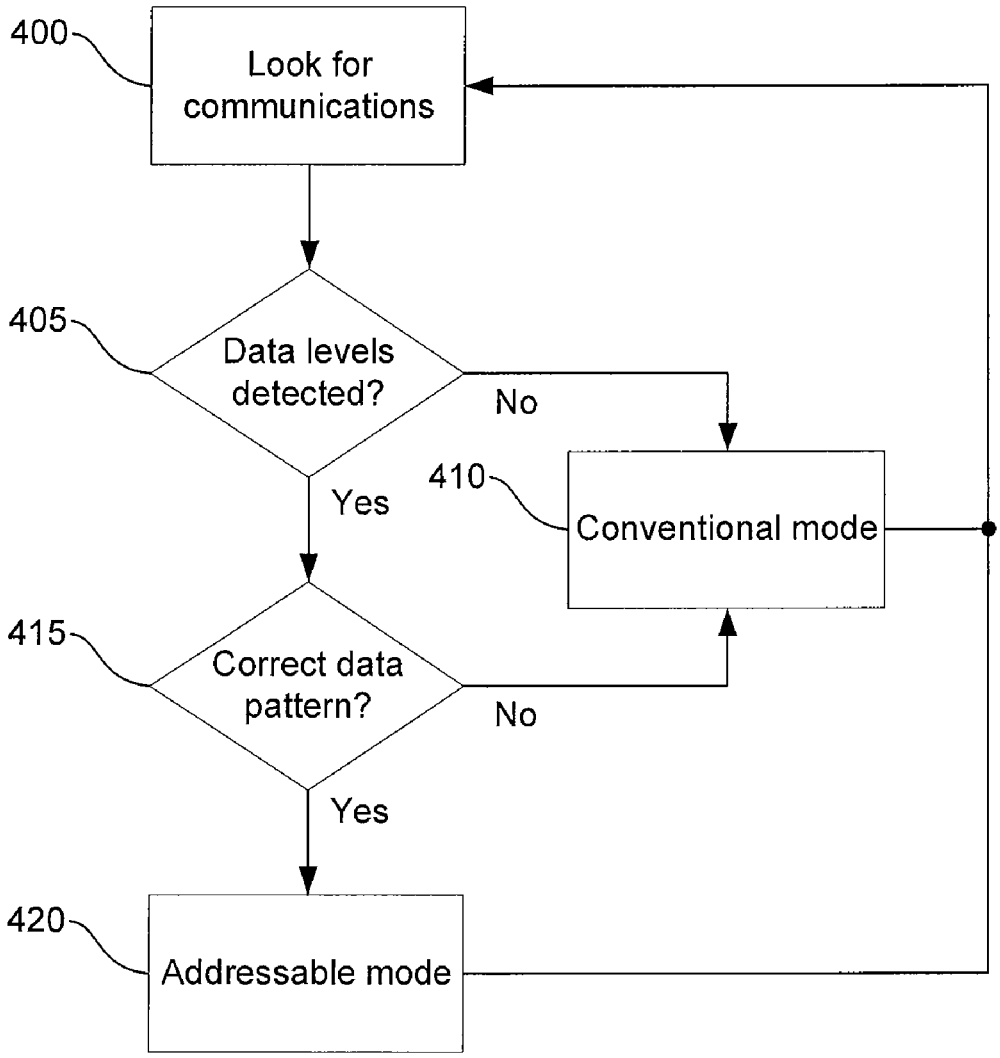
FIG. 4 is a block diagram of exemplary operations that may be performed by a notification device.

FIG. 4 is a block diagram of exemplary operations that may be performed by a notification device 115 (FIG. 1). The exemplary operations may be implemented via one or more instructions stored in a computer-readable medium, such as a read only memory (ROM), flash memory, or a different memory that is executable by a processor, such as the microcontroller.

At block 400, operations for detecting a communication mode capability of an alarm panel 120 (FIG. 1) may be performed. For example, a notification device 115 may enter this mode of operation during initial installation, during a power failure, and/or on a periodic basis, such as once every hour. This mode of operation may be entered at different times or for different reasons.

At block 405, signals on the network wiring 112 (FIG. 1) between the alarm panel 120 (FIG. 1) and the notification device 115 (FIG. 1) may be analyzed to determine whether data is being communicated on the network wiring. For example, one or more voltage threshold detectors of communication circuitry 205 (FIG. 2) may be utilized to determine whether the voltage on the network wiring 115 fluctuates between voltages corresponding to data bits.

If at block 405 data is not detected, then at block 410 the notification device 115 may be configured to communicate with the alarm panel 120 via a non-addressable communication mode. For example, the notification device 115 may remain in an idle or standby state when the polarity of the DC voltage on the wiring corresponds to a supervisory mode. The notification device 115 may enter an active state, such as the activation of a strobe, horn, or speaker, when the polarity of the DC voltage indicates an active mode.

If data is detected at block 405, then at block 415, the data may be analyzed to determine whether there are any data patterns in the detected data that are compatible with the notification device 115. For example, parallel-to-serial converters, shift registers, and other logic and circuitry of the communication circuitry 205 may be utilized to detect start bits, stop bits, parity bits, and/or data packets that include information for identifying and configuring notification devices 115. Compatible start bits, stop bits, parity bits, and data packets may conform to a standard protocol by which the notification device 115 is configured to communicate.

If the correct data patterns are not detected at block 415, then at block 410, the notification device 115 may be configured to communicate with the alarm panel 120 via a non-addressable communication mode, as describe above.

If the correct data patterns are detected at block 415, then at block 420, the notification device 115 may be configured to communicate with the alarm panel 120 via an addressable communication mode.

As shown, the notification device described above overcomes the problems with existing notification devices by providing a notification device that automatically configures itself to a communication protocol utilized by an alarm panel in an emergency alert system. For example, a processing module is configured to determine the communication mode capability of the alarm panel by determining whether data signals and compatible data patterns are present on the network wires that connect the alarm panel to the notification device. If compatible data patterns are detected, the notification device communicates with the alarm panel using an addressable communication mode.

If data patterns are not detected, the notification device enters an idle or standby state when the polarity of the DC voltage on the network wiring indicates a supervisory mode of operation. The notification device enters an active state when the polarity of the DC voltage indicates an active mode of operation. In the active mode, an output module, such a strobe module, a horn module, and/or a speaker module of the notification device is activated.

While the notification device and the method for operating the notification device have been described with reference to certain embodiments, it will be understood by those skilled in the art that various changes may be made and equivalents may be substituted without departing from the scope of the claims of the application. In addition, many other modifications may be made to adapt a particular situation to the teachings without departing from the scope of the claims. Therefore, it is intended that the claims of the application are not to be limited to the particular embodiments disclosed, but to any embodiments that fall within the scope of the claims.

We claim:

1. A notification device, the notification device comprising:

a processing module configured to determine whether an alarm panel communicates in one of an addressable mode or a non-addressable mode, and to receive and process a notification signal from the alarm panel using the determined communication mode, wherein the processing module communicates with the alarm panel via at least one conductor and is configured to communicate in the addressable mode of operation when a data pattern is present on the at least one conductor; and an output module in electrical communication with the processing module configured to produce an output signal in response to the notification signal received from the alarm panel.

2. The notification device according to claim 1, wherein the processing module is configured to operate in an addressable mode and a non-addressable mode.

3. The notification device according to claim 1, wherein the processing module communicates with the alarm panel over a pair of conductors.

4. The notification device according to claim 3, further comprising power control circuitry operable to generate power for the processing module and the output module from the pair of conductors.

5. The notification device according to claim 3, wherein the processing module further comprises communication circuitry operable to cause the processing module to communicate in an addressable mode of operation when data levels are present on the pair of conductors.

6. The notification device according to claim 3, wherein the processing module further comprises communication circuitry operable to cause the processing module to communicate in an addressable mode of operation when a data pattern is present on the pair of conductors.

7. The notification device according to claim 1, wherein the processing module is configured to determine the communication mode based on the position of a switch.

8. The notification device according to claim 1, wherein the output module includes an output device selected from the group consisting of: a strobe, a horn, a speaker, and any combination thereof.

9. The notification device according to claim 1, further comprising a base housing and an output module housing configured to be removably attached to the base housing, wherein the processing module is disposed in the base housing and the output module is disposed in the output module housing, and wherein the base housing is configured to be installed in a building, electrically connected to the alarm panel, and tested before the output module housing is attached.

10. The notification device according to claim 1, wherein the processing module communicates with the alarm panel over a pair of conductors.

11. The notification device according to claim 10, further comprising generating power for the processing module and the output module from the pair of conductors.

12. The notification device according to claim 10, further comprising communicating in an addressable mode of operation when data levels are present on the pair of conductors.

13. The notification device according to claim 10, further comprising communicating in an addressable mode of operation when a data pattern is present on the pair of conductors.

14. A method of operating a notification device, the method comprising:

determining, by a processing module, whether an alarm panel communicates in one of an addressable mode or a non-addressable mode, wherein the processing module communicates with the alarm panel via at least one conductor and is configured to communicate in the addressable mode of operation when a data pattern is present on the at least one conductor;

receiving a signal from the alarm panel according to the determined communication mode; and producing, via an output module, an output signal in response to the signal communicated by the alarm panel.

15. The method according to claim 14, wherein the processing module is configured to operate in an addressable mode and a non-addressable mode.

16. A machine-readable storage medium having stored thereon a computer program comprising at least one code section for operating a notification device, the at least one code section being executable by a machine for causing the machine to perform acts of:

determining whether an alarm panel communicates in one of an addressable mode or a non-addressable mode;

communicate with the alarm panel in the addressable mode of operation when a data pattern is detected via communication circuitry of the machine;

receiving a signal from the alarm panel according to the determined communication mode; and producing an output signal in response to the signal communicated by the alarm panel.

17. The machine-readable storage according to claim 16, wherein the at least one code section comprises code that enables the notification device to operate in an addressable mode and a non-addressable mode.

18. The machine-readable storage according to claim 16, wherein the at least one code section comprises code that enables the notification to communicate with the alarm panel over a pair of conductors.

19. The machine-readable storage according to claim 18, wherein the at least one code section comprises code that enables communicating in an addressable mode of operation when data levels are present on the pair of conductors.

20. The machine-readable storage according to claim 18, wherein the at least one code section comprises code that enables communicating in an addressable mode of operation when a data pattern is present on the pair of conductors.

21. A notification device comprising:

a processing module configured to communicate with an alarm panel in one of an addressable mode or a non-addressable mode, wherein the processing module is configured to communicate with the alarm panel in the addressable mode of operation when the processing module determines that the alarm panel communicates in the addressable mode of operation; and an output module in electrical communication with the processing module configured to produce an output signal in response to a signal communicated by the alarm panel, wherein the processing module is configured to detect a type of output module and communicate configuration information to the output module that is appropriate for the detected type of output module.

22. The notification device according to claim 21, wherein the output module is configured to communicate output module capabilities to the processing module.

23. The notification device according to claim 21, wherein the processing module further comprises storage circuitry configured to store configuration information associated with different types of output devices.

24. The notification device according to claim 23, wherein the configuration information is communicated to the processing module via an interface port of the processing module.

25. The notification device according to claim 21, wherein the output module includes an output device selected from the group consisting of: a strobe, a horn, a speaker, and any combination thereof.

26. The notification device according to claim 21, further comprising a base housing and an output module housing configured to be removably attached to the base housing, wherein the processing module is disposed in the base housing and the output module is disposed in the output module housing, and wherein the base housing is configured to be installed in a building, electrically connected to the alarm panel, and tested before the output module housing is attached.

* * * * *